US005350423A

United States Patent [19]

Davis, Jr. et al.

[11] Patent Number: 5,350,423

[45] Date of Patent: Sep. 27, 1994

[54] FABRIC FINISHING PROCEDURE

[75] Inventors: Ellis Davis, Jr., Easley, S.C.; James E. McFarland, Mooresville; Edward W. Teague, Raleigh, both of N.C.

[73] Assignee: Burlington Industries Inc., Greensboro, N.C.

[21] Appl. No.: 120,360

[22] Filed: Sep. 14, 1993

Related U.S. Application Data

[63] Continuation-in-part of Ser. No. 948,396, Sep. 23, 1992, abandoned.

[51] Int. Cl.[5] ..... C09B 67/00

[52] U.S. Cl. ..... 8/401; 8/108.1; 8/116.1; 8/478; 8/918

[58] Field of Search ..... 9/108.1, 478, 401, 116.1, 9/918

[56] References Cited

U.S. PATENT DOCUMENTS

| | | | |
|---|---|---|---|
| 4,417,897 | 11/1983 | Stahl . | |
| 4,740,212 | 4/1988 | Yant et al. | 8/108.1 |
| 4,740,213 | 4/1988 | Ricci | 8/108.1 |
| 4,816,033 | 3/1989 | Hoffer et al. | 8/158 |
| 4,832,864 | 5/1989 | Olson | 8/102 |
| 4,951,366 | 8/1990 | Geller | 26/28 |
| 5,006,124 | 4/1991 | Tieckelmann et al. | 8/111 |
| 5,006,126 | 4/1991 | Olson et al. | 8/401 |
| 5,114,426 | 5/1992 | Mildra et al. | 8/102 |
| 5,122,159 | 6/1992 | Olson et al. | 8/401 |
| 5,190,562 | 3/1993 | Dickson et al. | 8/111 |
| 5,215,543 | 6/1993 | Milori et al. | 8/102 |
| 5,225,047 | 7/1993 | Graef et al. | 162/9 |

FOREIGN PATENT DOCUMENTS

| | | |
|---|---|---|
| 0404009A1 | 12/1990 | European Pat. Off. . |
| 161580 | 7/1991 | Japan . |
| 2213482A | 8/1989 | United Kingdom . |

*Primary Examiner*—Paul Lieberman
*Assistant Examiner*—Margaret Einsmann
*Attorney, Agent, or Firm*—Nixon & Vanderhye

[57] ABSTRACT

Cotton denim fabrics are treated to enhance abrasion and shade reduction thereby reducing stonewashing time and expense by embrittling the fibers with an acid, heat-activated finish.

19 Claims, No Drawings

FABRIC FINISHING PROCEDURE

CROSS-REFERENCE TO RELATED APPLICATIONS

This application is a continuation-in-part of our earlier application Ser. No. 07/948,396, filed Sep. 23, 1992 now abandoned.

This invention provides enhanced abrasion and improved appearance in the stone washing, cellulase washing and other types of abrasion of garments.

BACKGROUND OF THE INVENTION

Stonewashing of cotton and cotton blend fabrics has gained great popularity and provides many styling applications in today's apparel market. This effect is chiefly applied to denim products but may be applied to cotton goods treated with vat, sulfur, reactive, direct and naphthol dyes, as well as pigments. Typically ring dyed yarns are woven and are then normally treated according to various so-called "stonewashing" processes that may or may not include abrasive materials to remove portions of the outer blue dyed yarns partially exposing the white portion of the yarn underneath. Stonewashing is costly and time consuming. The term "stone washing" and related descriptions herein refers to the use of abrasive stones such as pumice, cellulase enzymes or other treatments used to abrade fabrics or garments.

This invention provides an improved stonewashing effect while reducing or eliminating the use of abrasive materials by treating the ring dyed woven goods with a finish containing acid forming salts, solid organic acids, acid forming organic compounds, mineral acids or organic materials containing acid radicals, followed by drying, heating the goods to activate the acidic material, compressively shrinking and then cutting and sewing the garments followed by washing in garment form. The desired stonewashed look is achieved while saving one-third to one-half of the normal processing time and cost associated with conventional stonewashing.

The traditional procedure for providing a stonewashed appearance to garments is to expose the garment, typically denim jeans, to a combination of bleaching and an abrasive material. This combination provides a faded, worn appearance and is achieved by tumbling the garments with an abrasive substance, typically pumice stones and usually also with a bleaching solution such as potassium permanganate, a chlorine-based bleach or the like. Typically the garment to be stonewashed is denim or other type of cotton or a predominantly cotton garment in which the cotton yarn is ring dyed. When examined in cross section, the cotton fibers of the ring dyed yarn are dyed only around the outer circumference of the cotton yarn leaving the center portion or core undyed, hence the term "ring" when the yarns are viewed in cross section. Removal such as by abrasion or other means of a portion of the ring dyed outer surface of the yarn will leave the undyed portion exposed to view thus giving the faded appearance of a garment that has been worn for a considerable period of time. Abrasive treatment also imparts a worn, weathered appearance. In addition, the stonewashing process softens the hand of the garment giving it a more comfortable, less rigid, familiar feel and comfort when worn.

Conventional stonewashing procedures are time consuming and costly and provide garments which sometimes vary from batch to batch. In addition, stonewashing is usually performed on finished garments, that is garments in the completely constructed or fabricated condition. It would be desirable to provide a procedure that assures more uniform results prior to actual construction of the garment.

Several procedures have been proposed to achieve the appearance of stonewashed garments over shorter periods of time and/or at less cost. U.S. Pat. No. 4,816,033 describes a procedure for impregnating pumice rock with potassium permanganate solution under vacuum conditions, then tumbling the impregnated pumice rock with the garments to be stonewashed followed by neutralization, rinsing and drying. This procedure results in granules of pumice in the treatment and rinse water and also granules of pumice in the pockets and compartments of the constructed garments so treated.

A similar procedure for achieving a stonewashed look is described in U.S. Pat. No. 4,740,231 in which pumice granules are impregnated with a bleaching agent such as sodium hypochlorite. According to this disclosure the combined abrasive action from the pumice coupled with the bleaching action from the sodium hypochlorite reduces the processing time required to achieve the desired stonewashed appearance.

A difficulty with the use of pumice stones is that they average in size from 1 to 10 inches, often disintegrate into smaller size pieces and tend to accumulate in the pockets, interior closed or partially closed compartments and in the creases and folds of finished garments subjected to stonewashing. In addition, pumice powder tends to cause mechanical damage to the processing equipment and drive machinery, clogs drains and sewer lines and presents a sewage disposal problem for the finisher.

Chemical means without the use of abrasives to achieve the same or similar results have also been proposed. For example, U.S. Pat. No. 5,006,126 describes the use of cellulase enzyme to degrade or partially degrade the cellulosic fabric and release the dye from the fabric to achieve the stonewashed appearance with variations in local color density in fabric panels and seams of dyed cotton fabrics, especially denim.

A streaked, faded, worn appearance for denim is achieved according to U.S. Pat. No. 4,852,990 using a thickened/viscous aqueous solution of a chlorine bleaching agent in a polyacrylic acid. A similar procedure is described in U.K. patent application 2,213,842 A1 in which a fabric, typically denim, is decolorized selectively with a decolorizing paste to form patterns, characters or designs in the fabric followed by washing.

Published European application 0 404 009 describes the use of a dichloroisocyanuric acid salt as a decolorizing and bleaching agent for indigo fabrics.

Laid Open Japanese patent application 161,580/1991 describes a procedure for achieving a washed, worn-out appearance for cellulosic textile fabrics by applying a resin such as a cellulose reactive-type resin. The fabric is next scoured and bleached then subsequently dyed. The resin applied to the fabric acts as a dye resist, the areas of the fabric where the resin is present preventing the dye from entering and dyeing the cellulosic fabric resulting in a mottle dyed, washed and worn appearance.

Direct abrasion of denim fabric to achieve a softened, worn or laundered appearance with a stream of abrasive particles is described and illustrated in U.S. Pat. No. 4,951,366. The procedure is similar to that of sandblasting and the results achieved are said to resemble stonewashing.

The present invention achieves the desired worn, stonewashed appearance for denim and other types of cellulosic fabrics that are ring dyed by providing a controlled modification of the surface of the yarn, fabric, and/or dye such that further processing, for instance with strong bleaching agents, abrasive agents and the like or both, will result in the desired level of abrasion and stonewashed fabric appearance in a shorter period of time or at a reduced cost or, preferably, both.

DESCRIPTION OF THE INVENTION

This invention provides an improved stonewashing effect by treating ring dyed woven goods with a finish providing controlled embrittlement of the fabric or yarn surface, the finish containing acid forming salts, acid forming organic compounds, solid organic acids, mineral acids or organic materials which upon decomposition will form organic acids. First application is followed by drying, heating to activate the acidic material, compressively shrinking and then cutting and sewing the fabric into garments followed by washing in garment form to quickly produce a more uniform stonewash effect. The desired stonewashed look is achieved while saving one-third to one-half of the normal processing time and cost associated with conventional stonewashing.

The process of the present invention employs an organic or inorganic acid or acid-forming salt in an otherwise conventional finish formulation which is padded on to a cellulosic-based fabric, the yarns of which have previously been ring dyed.

Conveniently the finish is applied in open width before the fabric is constructed into garments. Following padding the fabric is dried and heated. The heating causes the acid-forming components to release acid or the acid present to break down and/or modify the cotton and the indigo dye contained in the yarns of the woven fabric. After the garment is produced, it may be subjected to washing, physical abrasion or stonewashing with bleach, depending on the effect that is desired for the final product.

Fabrics suitable for the process of the present invention are cellulosic fabrics, primarily cotton or cotton blends and typically denim-type products. In addition to indigo dyed denim products. The procedure according to the invention can be applied to all types of cotton garments dyed with many other classes of dyes including vat dyes, sulfur dyes, reactive dyes, direct dyes, naphthols and pigments that have used a ring dying procedure. Best stonewashed results are on cellulosic yarns that have been ring dyed such that when the ring dyed yarn is subjected to chemical processing, embrittlement and physical abrasion, a portion of the dye about the circumference of the yarn is removed revealing at least in part the underlying undyed fiber and giving the desired appearance. The procedure of the invention enables shorter overall processing time, less time during the stonewashing/abrasion procedure and therefore reduces costs, and increases product output.

In an alternative procedure, a denim or other suitable cellulosic fabric is treated with an acid-forming salt or solid organic acid or mineral acid contained in a finish which is padded onto or otherwise applied to the fabric, then dried, heated to a temperature sufficient to activate the acid salts or acid, then compressively shrunk to stabilize shrinkage and then constructed into a garment construction in the normal manner. Once the garment is completed it is subjected to a modified stonewashing procedure shorter than that normally employed with traditional stonewash/bleach, for example one-half to two-thirds of the normal time required.

The degree of embrittlement of the surface of the yarn with the fast abrasion finish according to this invention can be quantified in relation to a standard or normal finish by testing the surface of the fabric to varying degrees of abrasion. For example, conventional stone washing uses pumice stones in a two to one weight ratio (stones to garments) and is washed in a rotary washer for 30 minutes to two hours in 5 to 10 pounds of water, per pound of garments. The stone to garment ratio decreases as the size of the washing machine increases. For example, the stone to garment ratio of a 550 pound (theoretical load capacity) washing machine is approximately 1:1 and the ratio of water to garments decreases to 5:1 or less.

The fabric is examined to determine the amount of white core from the ring dyed yarns that shows on the surface of the abraded fabric. The amount of white undyed fiber showing on the surface of the fabric is directly proportional to the amount of dye and fiber removed by abrasion.

By using a standard untreated fabric as control in the washing procedure together with the treated fabric according to this invention the following relationships can be established:

In a wash cycle of one hour, the depth of shade on a treated garment is usually from 30% to 70% and preferably approximately 50% lighter than a standard control garment.

As a second step and alternative procedure, the abraded shade of the control garment washed for about one hour can be used as a standard for the abraded shade and time cycle on treated garments then reduced to the point where the abraded shades are equal. The degree of embrittlement is rated by the reduction in cycle time to achieve equal abraded shade with untreated garment as 30% improvement —embrittlement
50% improvement —embrittlement
70% improvement —embrittlement.

The controlled degradation of the ring dyed cotton yarn by this process is achieved by treating with or applying to ring dyed cotton yarn a yarn or dye modifying composition or finish containing as the modifying agent or agents solid acids such as citric, oxalic, tartaric, lactic, boric or benzoic acid and acid forming organic compounds such as lactones, compounds containing carbamide structures, or halogenated alcohols. Acid forming salts can also be used to embrittle the cotton fiber. Among those suitable for this purpose are zinc chloride, zinc nitrate, ammonium nitrate, barium chloride, potassium and sodium acid phosphate, aluminum chloride, aluminum nitrate, potassium acid phthalate, silver nitrate, silver chloride, calcium chloride, copper sulfate, copper nitrate, zinc sulfate, aluminum sulfate, cadmium sulfate, cadmium nitrate, cadmium chloride, magnesium chloride, manganese sulfate, manganese bromide, ammonium hypophosphite, ammonium acid sulfate, ammonium fluoride, nickel chloride, nickel hypophosphite, nickel nitrate, nickel phosphate, hydrochloric acid, sulfuric acid, and phosphoric acid.

The heating temperature used to activate the reaction can vary from 200° F. to 425° F. depending on the acid or acid-forming salt(s) employed. The preferred range is 340°-380° F. with the most preferred temperature being the minimum temperature that will give the required embrittlement at tile finish level used, generally 350° F. The temperature used varies inversely with the acid-forming strength of the acid source in the fabric finish. The stronger (more fabric embrittlement) the acid, the lower the temperature that is required. The requisite degree of abrasion is predictable by the skilled operator based on previous experience with a specific acid or acid-forming salt and quantity, type of fabric and construction, wet pick-up of material, and temperature of activation. Exact degree of abrasion may require slight adjustments in the above variables in order to achieve comparable results on different fabric constructions.

The invention is further illustrated by the following non-limiting examples in which all parts and percentages are by weight and temperatures reported in °F. unless otherwise indicated.

EXAMPLE 1

A pad bath was prepared from the following formulation:

| | | |
|---|---|---|
| Starch | 3.7% | Clinco 277-B, a modified finish starch, from Clinton Starch Co. |
| Acid-forming compounds | 22% | Pomorez HB-33, an aqueous solution containing 16.7% magnesium chloride from Piedmont Chemical Co. |
| Wetting agent | .25% | Sedgemul RW, a nonionic wetter and rewetter from Sedgefield Chemical Co. |
| Softener | 0.4% | Moropol HD-25, an emulsion of high density polyethylene softener from Moretex Chemical Co. |

The components of the pad bath were mixed in the order listed in the form of an aqueous solution containing 3.67% magnesium chloride, an acid forming salt. Denim fabric to be treated was immersed in open width in the pad bath maintained at a temperature of 140° F. The fabric was removed from the pad bath and squeezed to reduce moisture pick up to 65%, then dried in a tenter oven at 300° F. followed by heat activation for two minutes at 340° F. Finally, the treated fabric was compressively shrunk to zero shrinkage. The resulting product was then suitable for garment construction. Thereafter, the constructed garment was subjected to stonewashing to remove the embrittled outer portions of the thus treated cotton yarn. The popular stonewashed, worn look was achieved in a shorter period of time than without the embrittlement treating process of the present invention.

EXAMPLE 2

Four pounds of denim fabric from the preceding example were desized in a Kenmore washing machine with 1 oz. of Orvus Hytemp Granules and 1 oz. of Vircoscour New LF, then bleached with ½ gallon of Clorox (a sodium hypochlorite solution) for 20 minutes, followed by neutralization of the clorox with 1 oz of sodium bisulfite. The resulting light blue shade was equal to that normally obtained on denim fabric with 1.0 gal. of Clorox for 45 minutes.

EXAMPLE 3

A pad bath was prepared from the following formulation

| | | |
|---|---|---|
| Wetting agent | 0.5% | Sedgemul RW |
| Zinc nitrate | 1.7% | |
| Carbamide | 3.2% | |
| Starch | 2.0% | Clinco 277-B |
| Softener | 1.5% | Moropol HD-25 |

The components of the pad bath were mixed in the order listed to form an aqueous solution containing 1.7% zinc nitrate. Denim fabric to be treated was immersed in open width in the pad bath maintained at a temperature of 140° F. The fabric was removed from the pad bath and squeezed to reduce moisture pick up to 65%, then dried in a tenter oven at 300° F. followed by heat activation for two minutes at 340° F. Finally, the treated fabric was compressively shrunk to zero shrinkage. The resulting product was then suitable for garment construction. Thereafter, the constructed garment was subjected to stonewashing to remove the embrittled outer portions of the thus treated cotton yarn.

This example illustrates the combined effect of zinc nitrate, an acid forming salt, to achieve embrittlement of the cotton fabric and carbamide to increase the susceptibility of the indigo dye to chlorine bleach. Comparing the results obtained in Example 3 with Example 1, zinc nitrate is a more aggressive acid forming salt and thus was used in a lower concentration than the magnesium chloride.

The use of acid-forming salts embrittles the cotton fiber to achieve the desired stonewashed appearance but also decreases the overall strength of the fabric. The more embrittlement/damage to the fabric and associated loss of fabric strength, the better in abrasion washing. For most commercial uses strength loss of 10 to 15% is tolerated.

The use of carbamide to render the indigo dye more amenable to bleach achieves the desired stonewashed appearance while minimizing loss of fabric strength. Desirably when used carbamide is present in a concentration of from 5 to 75 grams per liter, preferably in the range of about 30 to 32 grams per liter, where the padded pickup is 50% on weight of fabric. The concentration of the acid forming salt in this combination varies with the characteristics of the acid formed. We have found zinc nitrate in pad bath concentrations ranging from 0.5 to 6.0%, preferably about 1.7 to 2%, the equivalent of 17 to 20 grams per liter, to provide the most effective overall performance with minimum yellowing of the fibers.

In another embodiment of the invention the fiber embrittlement/stonewashing process is applied to warp yarns only, prior to weaving which saves the time, expense and equipment necessary to treat the entire woven fabric. Further, it eliminates the possibility of strength loss in the filling yarn caused by the fabric treating process.

In addition to the faster abrasion achieved by stone, enzyme or enzyme and stone washes for abrading the embrittled fibers provided by this process, further reduction in wash cycle time can be made by the addition of a chlorine bleach, for example sodium hypochlorite, to the wash process. Currently the addition of bleach is a standard component in commercial denim stone washing processing but the accelerated abrasion finishing achieved by the process of the present invention, and the amount of bleach required to achieve comparable results is reduced to 50–75% and processing time is reduced by 40–65%.

We claim:

1. A process for providing a washed and worn appearance and softened hand to a ring dyed 100% cellulosic fabric comprising the steps of:

(a) applying to ring dyed 100% cellulosic yarns or fabric an organic acid or an acid-forming compound in an amount sufficient to embrittle the outer cellulosic fibers and render them more susceptible to subsequent abrasion, which acid or compound when activated by heat causes embrittlement of the dyed cellulosic fibers on the outer surface of the fabric;

(b) drying the thus-treated fabric;

(c) heating the fabric to a temperature in the range of about 200° F. to about 423° F. and for a time sufficient to activate the acid or acid-forming compound and cause embrittlement of the outer portions of the ring dyed cellulosic fabric; and thereafter (d) abrading the fabric to remove the embrittled dyed cellulosic fibers therein revealing the underlying undyed portion of the cellulosic yarn to provide a fabric having a washed and worn appearance and softened hand.

2. The process of claim 1 in which the cellulosic fabric is cotton.

3. The process of claim 2 in which the fabric is indigo dyed cotton denim.

4. The process of claim 1 in which the organic acid or acid-forming compound is applied to the fabric by padding.

5. The process of claim 1 in which the acid or acid-forming compound is activated in step (c) at a temperature in the range of about 340° F. to about 380° F.

6. The process of claim 1 in which the treated fabric in step (d) is abraded with pumice stones.

7. The process of claim 1 in which the fabric is stonewashed in step (d) with pumice stones and a chlorine bleach.

8. The process of claim 1 in which subsequent to step (c) the fabric is compressively shrunk.

9. The process of claim 1 in which the fabric is constructed into a garment prior to step (d).

10. The process of claim 9 in which the garment is abraded in step (d) by tumbling with pumice stones in an aqueous hypochlorite solution.

11. The process of claim 9 in which the garment is treated in step (d) with a cellulase enzyme to remove the cellulosic fibers from the outer surface of the ring dyed yarns.

12. A process of imparting a stonewashed, worn, soft appearance and hand to a 100% cellulosic fabric comprising the steps of:

(a) applying a solution of an acid or acid-forming compound which when heat activated causes embrittlement of dyed 100% cellulosic fibers to a fabric woven from ring dyed cellulosic yarns, the solution applied in an amount sufficient to embrittle the outer cellulosic fibers and render them more susceptible to subsequent abrasion;

(b) drying the thus-treated fabric;

(c) heating the treated and dried fabric to a temperature sufficient to activate the acid or acid forming salt or salts thereby causing embrittlement of the cellulosic fibers in the fabric;

(d) optionally washing the modified fabric of step (c) to remove the acid or acid-forming compounds and dyeing;

(e) compressively shrinking the fabric to essentially zero shrinkage;

(f) constructing the fabric of step (e) into a garment;

(g) tumbling the garment of step (f) with pumice stones and an aqueous hypochlorite solution to abrade and remove a portion of the outer surface of the embrittled ring dyed 100% cellulosic yarn to reveal the underlying undyed cellulose fibers and to impart a soft hand and worn, stone-washed appearance to the constructed garment.

13. The process of claim 12 in which the fabric is indigo dyed denim.

14. A stonewashed, faded garment produced by the process of claim 12.

15. A process for modifying the surface of 100% cellulosic yarn or fabric facilitating later removal of the modified fabric to provide a washed and worn appearance and softened hand to a ring dyed cellulosic fabric, the process comprising the steps of:

(a) applying to ring dyed 100% cellulosic yarns or fabric an organic acid or an acid-forming compound in an amount sufficient to embrittle the outer cellulosic fibers and render them more susceptible to subsequent abrasion which acid or compound when activated by heat causes embrittlement of the dyed 100% cellulosic fibers on the outer surface of the product;

(b) drying the thus-treated product;

(c) heating the fabric to a temperature in the range of about 200° F. to about 425° F. and for a time sufficient to activate the acid or acid-forming compound and cause embrittlement of the outer portions of the ring dyed cellulosic fabric.

16. The process of claim 15 in which the embrittled dyed cellulosic fibers and a portion of the dye therein are removed revealing the underlying undyed portion of the cellulosic yarn to provide a fabric having a washed and worn appearance and softened hand.

17. The process of claim 16 in which the modified fibers are removed by abrasion with pumice stones.

18. The process of claim 16 in which the modified fibers are removed by abrasion with pumice stones and a chlorine bleach.

19. The process of claim 16 in which the modified fibers are removed by abrasion with cellulase enzyme.

* * * * *